United States Patent [19]

Sequeira, Jr. et al.

[11] 4,169,766

[45] Oct. 2, 1979

[54] CONTROL SYSTEM FOR AN N-METHYL-2-PYRROLIDONE REFINING UNIT RECEIVING LIGHT SOUR CHARGE OIL

[75] Inventors: Avilino Sequeira, Jr.; Frank L. Barger, both of Port Arthur, Tex.

[73] Assignee: Texaco Inc., White Plains, N.Y.

[21] Appl. No.: 952,897

[22] Filed: Oct. 19, 1978

[51] Int. Cl.[2] ..... C10G 21/00; C06G 7/58

[52] U.S. Cl. ..... 196/14.52; 364/497; 364/501; 422/62

[58] Field of Search ..... 196/14.52; 422/62; 23/230 A; 364/497, 501

[56] References Cited

U.S. PATENT DOCUMENTS

| | | | |
|---|---|---|---|
| 3,799,871 | 3/1974 | Sequeira et al. | 196/14.52 |
| 3,911,259 | 10/1975 | Huddleston et al. | 364/501 |
| 3,972,779 | 3/1976 | Harrison | 196/14.52 |
| 4,053,744 | 10/1977 | Woodle | 196/14.52 |

*Primary Examiner*—R. E. Serwin

*Attorney, Agent, or Firm*—Thomas H. Whaley; Carl G. Ries; Ronald G. Gillespie

[57] ABSTRACT

A refining unit treats light sour charge oil with N-methyl-2-pyrrolidone solvent, hereafter referred to as MP, in a refining extractor to yield raffinate and extract mix. The MP is recovered from the raffinate and from the extract mix and returned to the refining extractor. A system controlling the refining unit includes a gravity analyzer, a sulfur analyzer and viscosity analyzers; all sampling the light sour charge oil and providing corresponding signals. Sensors sense the flow rates of the charge oil and the MP flowing into the extractor and the temperature of the extract mix and provide corresponding signals. One of the flow rates of its light sour charge oil and the MP flow rates is controlled in accordance with the signals from all the analyzers and all the sensors, while the other flow rate of the light sour charge oil and the MP flow rates is constant.

9 Claims, 13 Drawing Figures

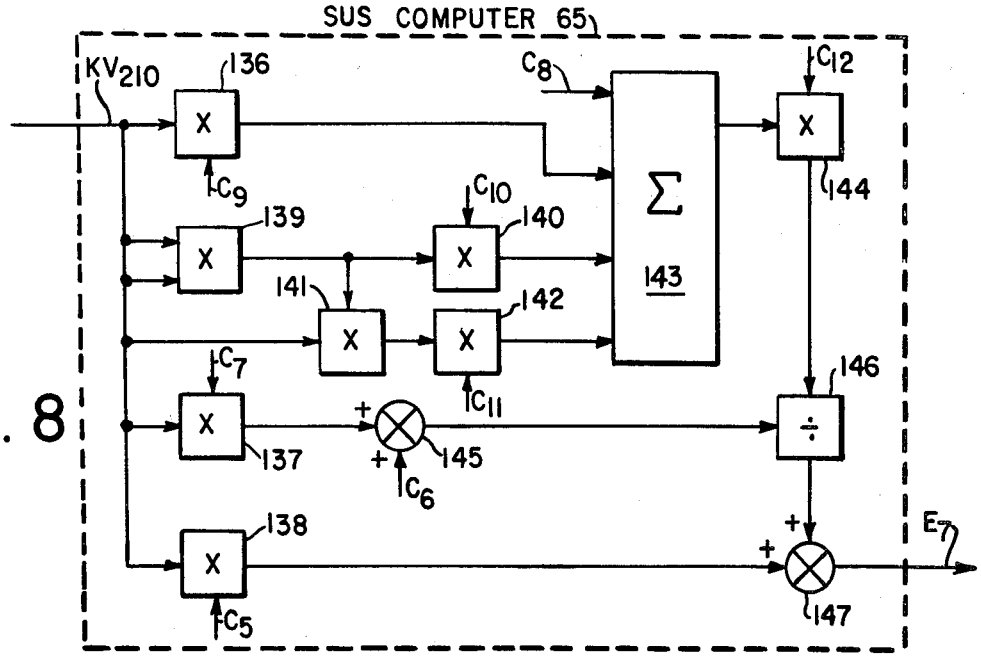
FIG. 8
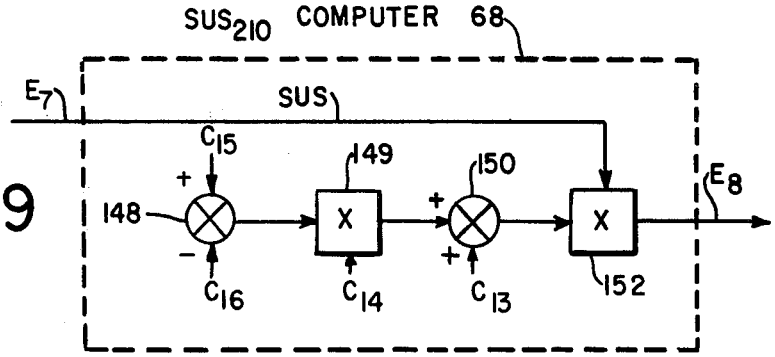
FIG. 9
FIG. 11
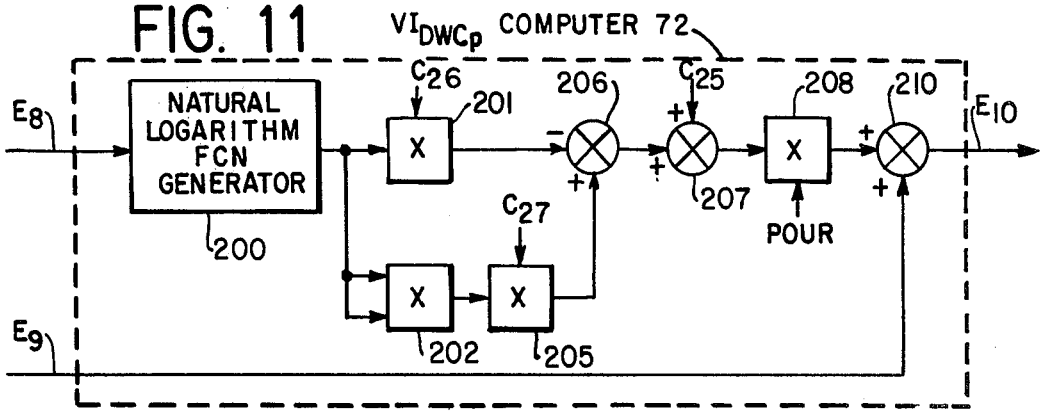

CONTROL SYSTEM FOR AN N-METHYL-2-PYRROLIDONE REFINING UNIT RECEIVING LIGHT SOUR CHARGE OIL

BACKGROUND OF THE INVENTION

Field of the Invention

The present invention relates to control systems and methods in general and, more particularly, to control systems and methods for oil refining units.

SUMMARY OF THE INVENTION

A refining unit treats light sour charge oil with an MP solvent in an extractor to yield raffinate and extract mix. The MP is recovered from the raffinate and from the extract mix and returned to the extractor. A system controlling the refining unit includes a gravity analyzers, a sulfur analyzer and viscosity analyzers. The analyzers analyze the light sour charge oil and provide corresponding signals. Sensors sense the flow rates of the charge oil and the MP flowing into the extractor and the temperature of the extract-mix and provide corresponding signals. The flow rate of the light sour charge oil or the MP is controlled in accordance with the signals provided by all the sensors and the analyzers while the other flow rate of the light sour charge oil or the MP is constant.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustrative purposes only and are not to be construed as defining the limits of the invention.

DESCRIPTION OF THE DRAWINGS

FIGS. 3 through 13 are detailed block diagrams of the H computer, the K signal means, the H signal means, the KV computer, the VI signal means, the SUS computer, the $SUS_{210}$ computer, the $VI_{DWCO}$ computer, the $VI_{DWCP}$ computer, the ΔRI computer and the J computer, respectively, shown in FIG. 2.

DESCRIPTION OF THE INVENTION

Figure 1:
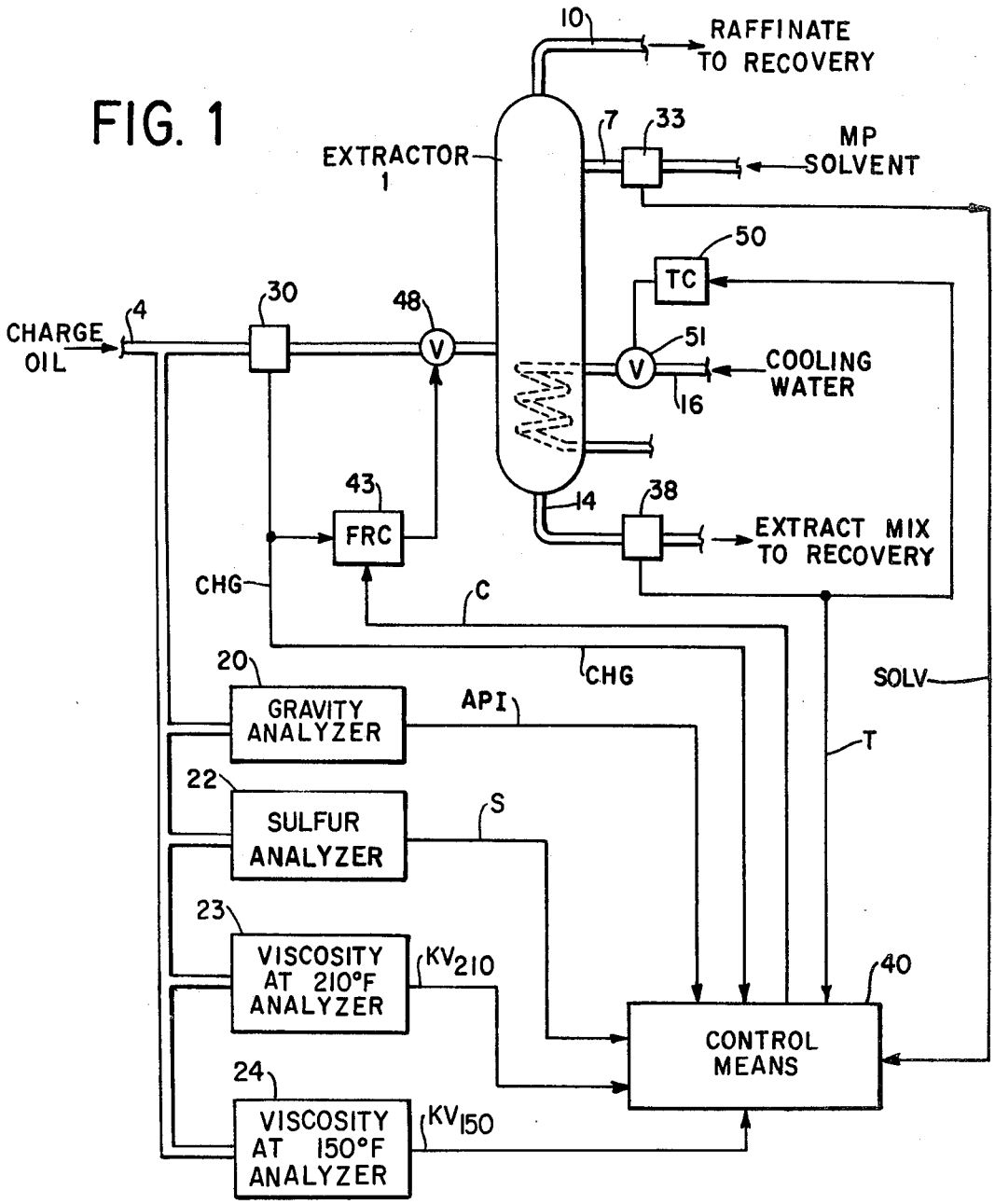
FIG. 1 shows an MP refining unit in partial schematic form and a control system, constructed in accordance with the present invention, in simple block diagram form.

An extractor 1 in an N-methyl-2-pyrrolidone refining unit is receiving sour light charge oil by way of a line 4 and N-methyl-2-pyrrolidone solvent, hereafter referred to as MP, by way of a line 7 and providing raffinate to recovery by way of a line 10, and an extract mix to recovery by way of a line 14.

Light sour charge oil is a charge oil having a sulfur content greater than a predetermined sulfur content and having a kinematic viscosity, corrected to a predetermined temperature, equal to or less than a predetermined kinematic viscosity. Preferably, the predetermined sulfur content is 1.0%, the predetermined temperature is 210° F., and the predetermined kinematic viscosity is 7.0. The temperature in extractor 1 is controlled by cooling water passing through a line 16. A gravity anaylyzer 20, a sulfur analyzer 22 and viscosity analyzers 23 and 24 sample the charge oil in line 4 and provide signals API, S, $KV_{210}$ and $KV_{150}$, respectively, corresponding to the API gravity, the sulfur content, the kinematic viscosity at 210° F., the kinematic viscosity at 150° F. and 210° F., respectively, of the light sour charge oil.

A flow transmitter 30 in line 4 provides a signal CHG corresponding to the flow rate of the light sour charge oil in line 4. Another flow transmitter 33 in line 7 provides a signal SOLV corresponding to the MP flow rate. A temperature sensor 38, sensing the temperature of the extract mix leaving extractor 1, provides a signal T corresponding to the sensed temperature. All signals hereinbefore mentioned are provided to control means 40.

Control means 40 provides signal C to a flow recorder controller 43. Recorder controller 43 receives signals CHG and C and provides a signal to a valve 48 to control the flow rate of the light sour charge oil in line 4 in accordance with signals CHG and C so that the light sour charge oil assumes a desired flow rate. Signal T is also provided to temperature controller 50. Temperature controller 50 provides a signal to a valve 51 to control the amount of cooling water entering 1 and hence the temperature of the extract-mix in accordance with its set point position and signal T.

The following equations are used in practicing the present invention for light sour charge oil:

$$H_{210}=\ln\ln(KV_{210}+C_1) \quad 1.$$

where $H_{210}$ is a viscosity H value for 210° F., $KV_{210}$ is the kinematic viscosity of the charge oil at 210° F. and $C_1$ is a constant having a preferred value of 0.6.

$$H_{150}=\ln\ln(KV_{150}+C_1) \quad 2.$$

where $H_{150}$ is a viscosity H value for 150° F., and $KV_{150}$ is the kinematic viscosity of the charge oil at 150° F.

$$K_{150}=[C_2-\ln(T_{150}+C_3)]/C_4 \quad 3.$$

where $K_{150}$ is a constant needed for estimation of the kinematic viscosity at 100° F., $T_{150}$ is 150, and $C_2$ through $C_4$ are constants having preferred values of 6.5073, 460 and 0.17937, respectively.

$$H_{100}=H_{210}+(H_{150}-H_{210})/K_{150} \quad 4.$$

where $H_{100}$ is a viscosity H value for 100° F.

$$KV_{100}=\exp[\exp(H_{100})]-C_1 \quad 5.$$

where $KV_{100}$ is the kinematic viscosity of the charge oil at 100° F.

$$SUS=C_5(KV_{210})+[C_6+C_7(KV_{210})]/[C_8+C_9(KV_{210})+C_{10}(KV_{210})^2+C_{11}(KV_{210})^3](C_{12}) \quad 6.$$

where SUS is the viscosity in Saybolt Universal Seconds and $C_5$ through $C_{12}$ are constants having preferred values of 4.6324, 1.0, 0.03264, 3930.2, 262.7, 23.97, 1.646 and $10^{-5}$, respectively.

$$SUS_{210}=[C_{13}+C_{14}(C_{15}-C_{16})]SUS \quad 7.$$

where $SUS_{210}$ is the viscosity in Saybolt Universal Seconds at 210° F. and $C_{13}$ through $C_{16}$ are constants having preferred values of 1.0, 0.000061, 210 and 100, respectively.

$$VI_{DWCO} = -C_{17} + C_{18}(S) + C_{19}(KV_{210})^2 + C_{20}(VI)^2 + C_{21}(S)^2 + C_{22}(API)(KV_{210}) - C_{23}(KV_{210})(VI) + C_{24}(VI)(S), \quad 8.$$

where $VI_{DWCO}$ is the viscosity index of the dewaxed charge oil at 0° F. and $C_{17}$ through $C_{24}$ are constants having preferred values of 18.067, 51.155, 1.0108, 0.0084733, 2.2188, 1.0299, 0.34233 and 0.67215, respectively.

$$VI_{DWCP} = VI_{DWCO} + (Pour)[C_{25} - C_{26} \ln SUS_{210} + C_{27}(\ln SUS)^2], \quad 9.$$

where $VI_{DWCP}$ and Pour are the viscosity index of the dewaxed product at a predetermined temperature and the Pour Point of the dewaxed product, respectively, and $C_{25}$ through $C_{27}$ are constants having preferred values of 2.856, 1.18 and 0.126, respectively.

$$\Delta VI = VI_{RO} - VI_{DWCO} = VI_{RP} - VI_{DWCP}, \quad 10.$$

where $VI_{RO}$ and $VI_{RP}$ are the VI of the refined oil at 0° F., and the predetermined temperature, respectively.

$$\Delta RI = [C_{28} + C_{29}(KV_{210}) - C_{30}(S)^2 + C_{31}(\Delta VI)(API) - C_{32}(API)^2 + C_{33}(API)(KV_{210}) + C_{34}(VI)^2 - C_{35}(KV_{210}) + C_{36}(VI)(S) + C_{37}(\Delta VI)(KV_{210})]C_{38}, \quad 11.$$

where ΔRI is the difference in refractive indexes of the light sour charge oil and the raffinate and $C_{28}$ through $C_{38}$ are constants having preferred values of 99.848, 41.457, 32.735, 0.11641, 0.37573, 23635, 0.03488, 1.3274, 1.2068, 0.25432 and $10^{-4}$, respectively.

$$J = C_{39} - C_{40}(\Delta VI) - C_{41}(KV_{210})^2 - C_{42}(S)(T) + C_{43}(KV_{210})(T) - C_{44}(VI) + C_{45}(\Delta VI)(\Delta RI), \quad 12.$$

where J is the MP dosage and $C_{39}$ through $C_{45}$ are constants having preferred values of 1495.9, 28.791, 23.287, 2.8512, 0.6435, 3.7239 and 639.44, respectively.

$$C = (SOLV)(100)/J \quad 13.$$

where C is the new charge oil flow rate.

Figure 2:
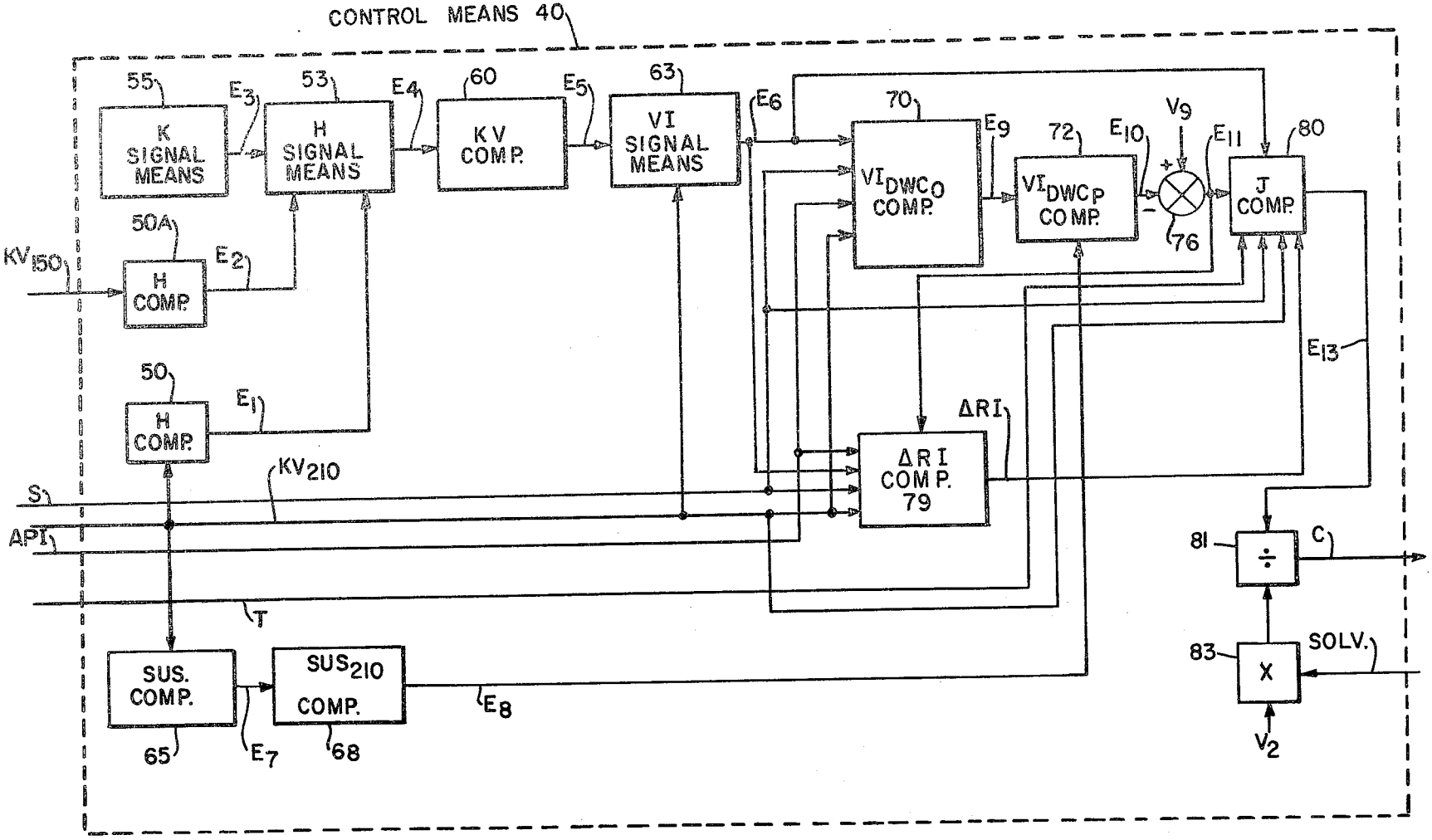
FIG. 2 is a detailed block diagram of the control means shown in FIG. 1.

Referring now to FIG. 2, signal $KV_{210}$ is provided to an H computer 50 in control means 40, while signal $KV_{150}$ is applied to an H computer 50A. It should be noted that elements having a number and a letter suffix are similar in construction and operation as to those elements having the same numeric designation without a suffix. All elements in FIG. 2, except elements whose operation is obvious, will be disclosed in detail hereinafter. Computers 50 and 50A provide signals $E_1$ and $E_2$ corresponding to $H_{210}$ and $H_{150}$, respectively, in equations 1 and 2, respectively, to H signal means 53. K signal means 55 provides a signal $E_3$ corresponding to the term $K_{150}$ in equation 3 to H signal means 53. H signal means 53 provides a signal $E_4$ corresponding to the term $H_{100}$ in equation 4 to a KV computer 60 which provides a signal $E_5$ corresponding to the term $KV_{100}$ in accordance with signal $E_4$ and equation 5 as hereinafter explained.

Signals $E_5$ and $KV_{210}$ are applied to VI signal means 63 which provides a signal $E_6$ corresponding to the viscosity index.

An SUS computer 65 receives signal $KV_{210}$ and provides a signal $E_7$ corresponding to the term SUS in accordance with the received signals and equation 6 as hereinafter explained.

An SUS 210 computer 68 receives signal $E_7$ and applies signal $E_8$ corresponding to the term $SUS_{210}$ in accordance with the received signal and equation 7 as hereinafter explained.

A $VI_{DWCO}$ computer 70 receives signal S, API, $KV_{210}$ and $E_6$ and provides a signal $E_9$ corresponding to the term $VI_{DWCO}$ in accordance with the received signals and equation 8 as hereinafter explained.

A $VI_{DWCP}$ computer 72 receives signal $E_8$ and $E_9$ and provides a signal $E_{10}$ corresponding to the term $VI_{DWCP}$ in accordance with the received signals and equation 9. Subtracting means 76 performs the function of equation 10 by subtracting signal $E_{10}$ from a direct current voltage $V_9$, corresponding to the term $VI_{RP}$, to provide a signal $E_{11}$ corresponding to the term ΔVI in equation 10.

A ΔRI computer 79 receives signals $KV_{210}$, S, ΔVI, API and VI and provides a signal ΔRI in accordance with the received signals and equation 11.

A J computer 80 receives signals $KV_{210}$, S, T, RI, $E_6$ and $E_{11}$ and provides a signal $E_{13}$ corresponding to the term J in accordance with the received signals and equation 12 as hereinafter explained to a divider 81.

Signal SOLV is provided to a multiplier 83 where it is multiplied by a direct current voltage $V_2$ corresponding to a value of 100 to provide a signal corresponding to the term (SOLV)(100) in equation 13. The product signal is applied to divider 81 where it is divided by signal $E_{13}$ to provide signal C corresponding to the desired new charge oil flow rate.

It would be obvious to one skilled in the art that if the charge oil flow rate was maintained constant and the MP flow rate varied, equation 13 would be rewritten as $$SO = (J)(CHG)/100 \quad 14.$$

where SO is the new MP flow rate. Control means 40 would be modified accordingly.

Figure 3:
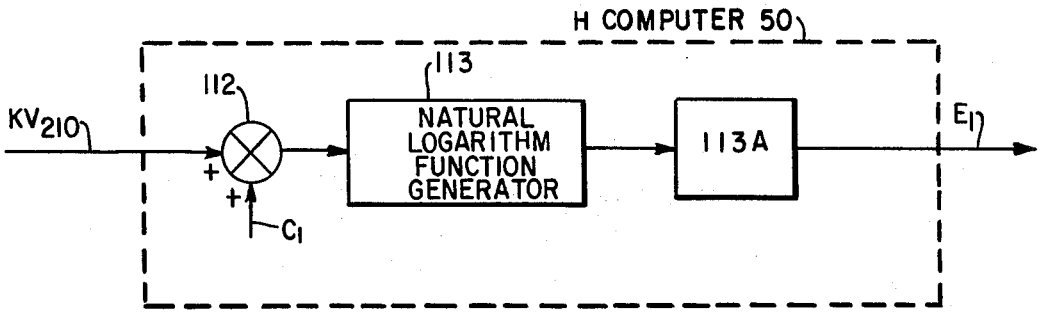

Referring now to FIG. 3, H computer 50 includes summing means 112 receiving signal $KV_{210}$ and summing it with a direct current voltage $C_1$ to provide a signal corresponding to the term $[KV_{210} + C_1]$ shown in equation 1. The signal from summing means 112 is applied to a natural logarithm function generator 113 which provides a signal corresponding to the natural log of the sum signal which is then applied to another natural log function generator 113A which in turn provides signal $E_1$.

Figure 4:
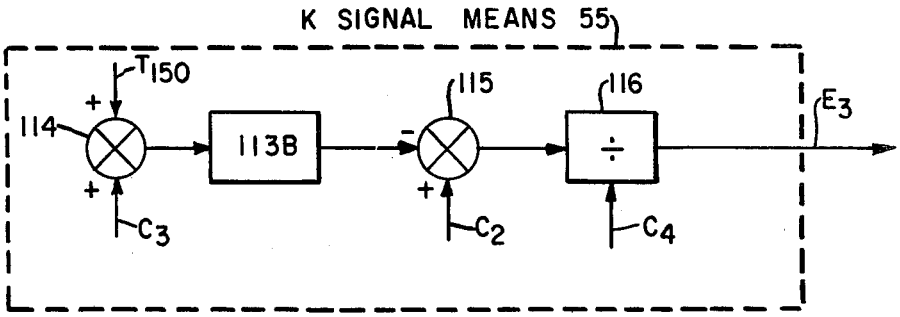

Referring now to FIG. 4, K signal means 55 includes summing means 114 summing direct current voltages $T_{150}$ and $C_3$ to provide a signal corresponding to the term $[T_{150} + C_3]$ which is provided to a natural log function generator 113B which in turn provides a signal corresponding to the natural log of the sum signal from summing means 114. Subtracting means 115 subtracts the signal provided by function generator 113B from a direct current voltage $C_2$ to provide a signal corresponding to the numerator of equation 3. A divider 116 divides the signal from subtracting means 115 with a direct current voltage $C_4$ to provide signal $E_3$.

Figure 5:
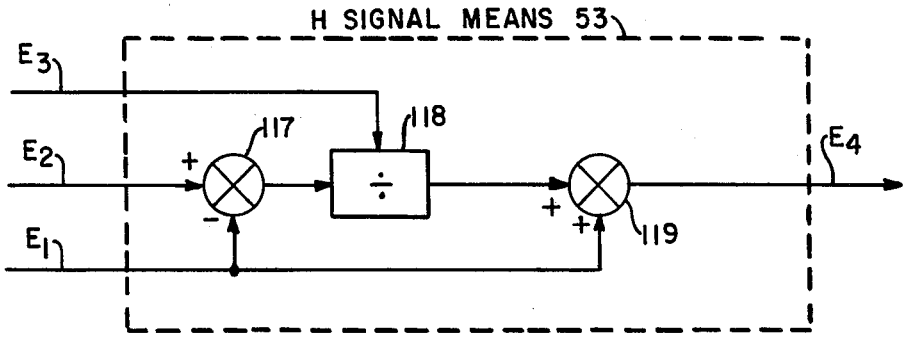

Referring now to FIG. 5, H signal means 53 includes subtracting means 117 which subtracts signal $E_1$ from signal $E_2$ to provide a signal corresponding to the term $H_{150} - H_{210}$, in equation 4, to a divider 118. Divider 118 divides the signal from subtracting means 117 by signal $E_3$. Divider 114 provides a signal which is summed with signal $E_1$ by summing means 119 to provide signal $E_4$ corresponding to $H_{100}$.

Figure 6:
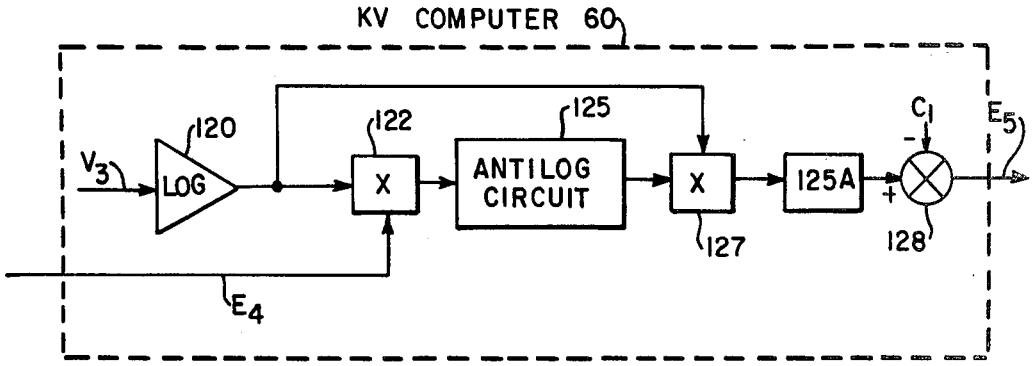

Referring now to FIG. 6, a direct current voltage $V_3$ is applied to a logarithmic amplifier 120 in KV computer 60. Direct current voltage $V_3$ corresponds to the mathematical constant e. The output from amplifier 120 is applied to a multiplier 122 where it is multiplied with signal $E_4$. The product signal from multiplier 122 is applied to an antilog circuit 125 which provides a signal corresponding to the term $\exp(H_{100})$ in equation 5. The signal from circuit 125 is multiplied with the output from logarithmic amplifier 120 by a multiplier 127 which provides a signal to antilog circuit 125A. Circuit 125A is provided to subtracting means 128 which subtracts a direct current voltage $C_1$ from the signal provided by circuit 125A to provide signal $E_5$.

Figure 7:
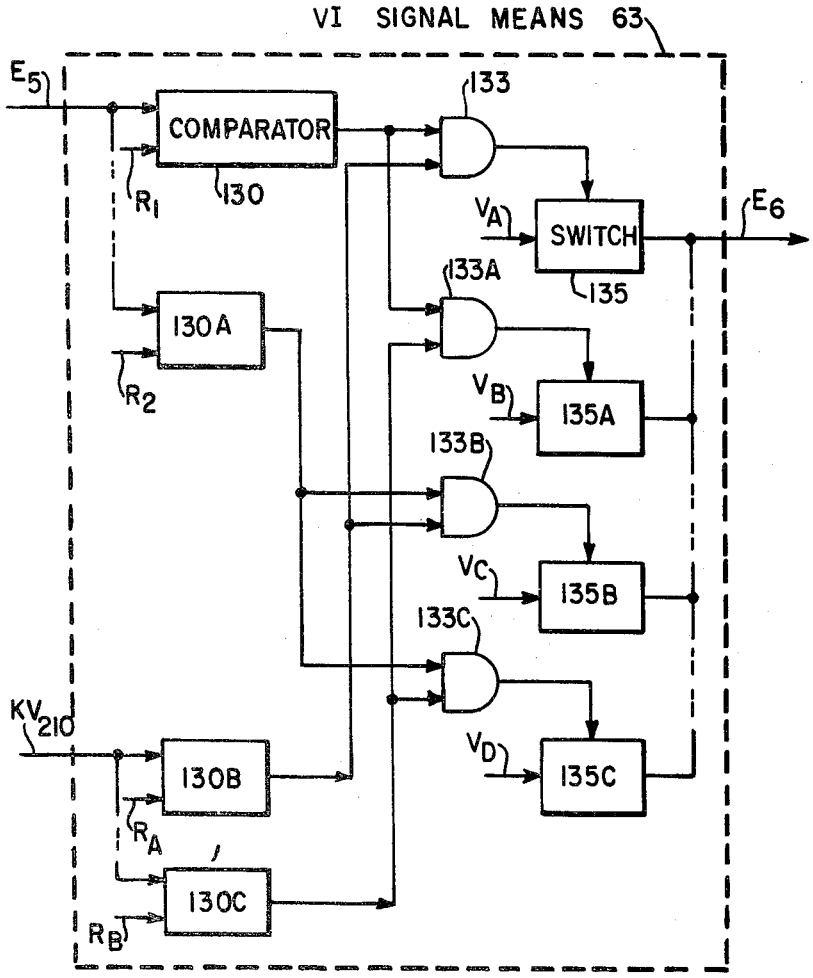

Referring now to FIG. 7, VI signal means 63 is essentially memory means which is addressed by signals $E_5$, corresponding to $KV_{100}$, and signal $KV_{210}$. In this regard, a comparator 130 and comparator 130A represent a plurality of comparators which receive signal $E_5$ and compare signal $E_5$ to reference voltages, represented by voltages $R_1$ and $R_2$, so as to decode signal $E_5$. Similarly, comparators 130B and 130C represent a plurality of comparators receiving signal $KV_{210}$ which compare signal $KV_{210}$ with reference voltages RA and RB so as to decode signal $KV_{210}$. The outputs from comparators 130 and 130B are applied to an AND gate 133 whose output controls a switch 135. Thus, should comparators 130 and 130B provide a high output, AND gate 133 is enabled and causes switch 135 to be rendered conductive to pass a direct current voltage $V_A$ corresponding to a predetermined value, as signal $E_6$ which corresponds to $VI_C$. Similarly, the outputs of comparators 130 and 130C control an AND gate 133A which in turn controls a switch 135A to pass or to block a direct current voltage $V_B$. Similarly, another AND gate 133B is controlled by the outputs from comparators 130A and 130B to control a switch 135B so as to pass or block a direct current voltage $V_C$. Again, an AND gate 133C is controlled by the outputs from comparators 130A and 130C to control a switch 135C to pass or to block a direct current voltage $V_D$. The outputs of switches 135 through 135C are tied together so as to provide a common output.

Referring now to FIG. 8, the SUS computer 65 includes multipliers 136, 137 and 138 multiplying signal $KV_{210}$ with direct current voltages $C_9$, $C_7$ and $C_5$, respectively, to provide signals corresponding to the terms $C_9(KV_{210})$, $C_7(KV_{210})$ and $C_5(KV_{210})$, respectively in equation 6. A multiplier 139 effectively squares signal $KV_{210}$ to provide a signal to multipliers 140, 141. Multiplier 140 multiplies the signal from multiplier 139 with a direct current voltage $C_{10}$ to provide a signal corresponding to the term $C_{10}(KV_{210})^2$ in equation 6. Multiplier 141 multiplies the signal from multiplier 139 with signal $KV_{210}$ to provide a signal corresponding to $(KV_{210})^3$. A multiplier 142 multiplies the signal from multiplier 141 with a direct current voltage $C_{11}$ to provide a signal corresponding to the term $C_{11}(KV_{210})^3$ in equation 6. Summing means 143 sums the signals from multipliers 136, 140 and 142 with a direct current voltage $C_8$ to provide a signal to a multiplier 144 where it is multiplied with a direct current voltage $C_{12}$. The signal from multiplier 137 is summed with a direct current voltage $C_6$ by summing means 145 to provide a signal corresponding to the term $[C_6+C_7(KV_{210}]$. A divider 146 divide the signal provided by summing means 145 with the signal provided by multiplier 144 to provide a signal which is summed with the signal from multiplier 138 by summing means 147 to provide signal $E_7$.

Referring now to FIG. 9, $SUS_{210}$ computer 68 includes subtracting means 148 which subtracts a direct current voltage $C_{16}$ from another direct current voltage $C_{16}$ from another direct current voltage $C_{15}$ to provide a signal corresponding to the term $(C_{15}-C_{16})$ in equation 7. The signal from subtracting means 148 is multiplied with a direct current voltage $C_{14}$ by a multiplier 149 to provide a product signal which is summed with another direct current voltage $C_{13}$ by summing means 150. Summing means 150 provides a signal corresponding to the term $[C_{13}+C_{14}(C_{15}-C_{16}]$ in equation 7. The signal from summing means 150 is multiplied with signal $E_7$ by a multiplier 152 to provide signal $E_8$.

Figure 10:
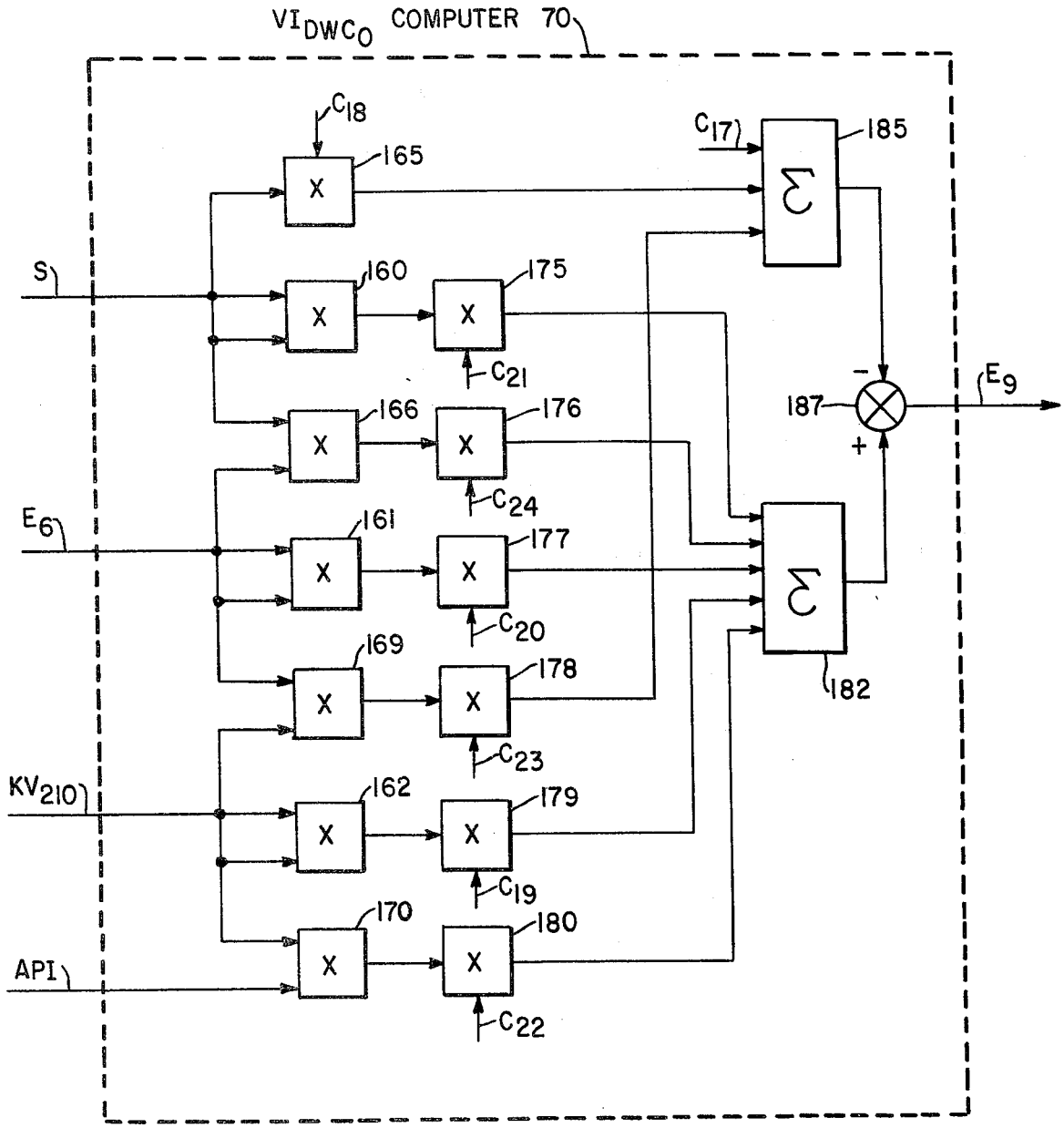

Referring now to FIG. 10, $VI_{DWCO}$ computer 70 includes multipliers 160, 161 and 162 which effectively square signals S, $E_6$ and $KV_{210}$, respectively, and provide corresponding signals. Multipliers 165, 166 multiply signal S with a direct current voltage $C_{18}$ and signal $E_6$, respectively, to provide product signals. Multipliers 169, 170 multiply signal $KV_{210}$ with signals $E_6$ and API, respectively, to provide product signals. Multipliers 175 through 180 multiply the signals from multipliers 160, 166, 161, 169, 162 and 170, respectively, with direct current voltages $C_{21}$, $C_{24}$, $C_{20}$, $C_{23}$, $C_{19}$ and $C_{22}$, respectively, to signals corresponding to the terms $C_{21}(S)^2$, $C_{24}(VI)(S)$, $C_{20}(VI)^2$, $C_{23}(KV_{210})(VI)$, $C_{19}(KV_{210})^2$ and $C_{22}(API)(KV_{210})$, respectively. in equation 8. Summing means 182 sums the signals from multipliers 175, 176, 177, 179 and 180, to effectively sum the positive terms of equation 8, and provides a corresponding sum signal. The negative terms of equation 8 are effectively summed when summing means 185 sums the signals from multipliers 165, 178 with a direct current voltage $C_{17}$. Subtracting means 187 subtracts the signal provided by summing means 185 from the signal provided by summing means 182 to provide signal $E_9$.

$VI_{DWCP}$ computer 72 shown in FIG. 11, includes a natural logarithm function generator 200 receiving signal $E_8$ and providing a signal corresponding to the term $\ln SUS_{210}$ to multipliers 201 and 202. Multiplier 170 multiplies the signal from function generator 168 with a direct current voltage $C_{26}$ to provide a signal corresponding to the term $C_{26} \ln SUS_{210}$ in equation 9. Multiplier 202 effectively squares the signal from function generator 200 to provide a signal that is multiplied with the direct current voltage $C_{27}$ by a multiplier 205. Multiplier 205 provides a signal corresponding to the term $C_{27}(\ln SUS_{210})^2$ in equation 9. Subtracting means 206 subtracts the signals provided by multiplier 201 from the signal provided by multiplier 205. Summing means 207 sums the signal from subtracting means 206 with a direct current voltage $C_{25}$. A multiplier 208 multiplies the sum signals from summing means 207 with a direct current voltage POUR to provide a signal which is summed with signal $E_9$ by summing means 210 which provides signal $E_{10}$.

Figure 12:
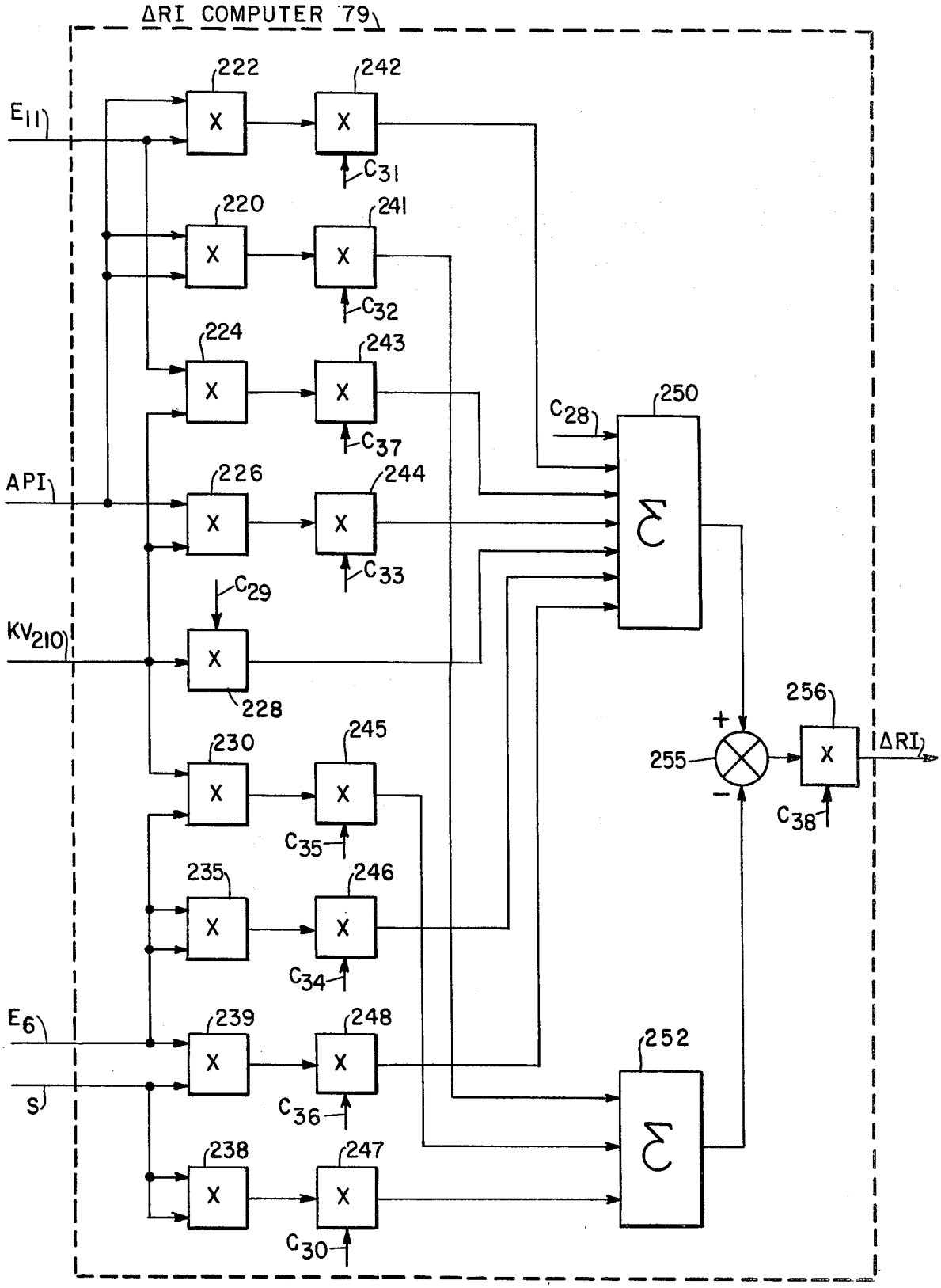

Referring to FIG. 12, multiplier 220 in ΔRI computer 79 effectively squares signal API while multipliers 222 and 224 multiply signal $E_{11}$ with signals API and $KV_{210}$, respectively, to provide product signals. Multipliers 235, 238 effectively square signals $E_6$ and S to provide product signals. Multipliers 241 through 248 multiply the product signals from multipliers 220, 222, 224, 226, 230, 235, 238 and 239, respectively, with direct current voltages $C_{32}$, $C_{31}$, $C_{37}$, $C_{33}$, $C_{35}$, $C_{34}$, $C_{30}$ and $C_{36}$, respectively, to provide signals corresponding to the terms $C_{32}(API)^2$, $C_{31}(\Delta VI)(API)$, $C_{37}(\Delta VI)(KV_{210})$, $C_{33}(API)(KV_{210})$, $C_{35}(VI)(KV_{210})$, $C_{34}(VI)^2$, $C_{30}(S)^2$ and $C_{36}(VI)(S)$, respectively, in equation 11. Summing means 250 effectively sums the positive terms of equation 11 when it sums a direct current voltage $C_{28}$ with the signals from multipliers 228, 242, 243, 244, 246 and 248 to provide a sum signal. Summing means 252 effectively sums the negative terms of equation 11 when it sums the signals from multipliers 241, 245 and 247 to provide a sum signal. Subtracting means 255 subtracts the sum signal provided by summing means 252 from the sum signal provided by summing means 250 to provide a signal which is multiplied with a direct current voltage $C_{38}$ by a multiplier 256. Multiplier 256 provides signal $\Delta RI$.

Figure 13:
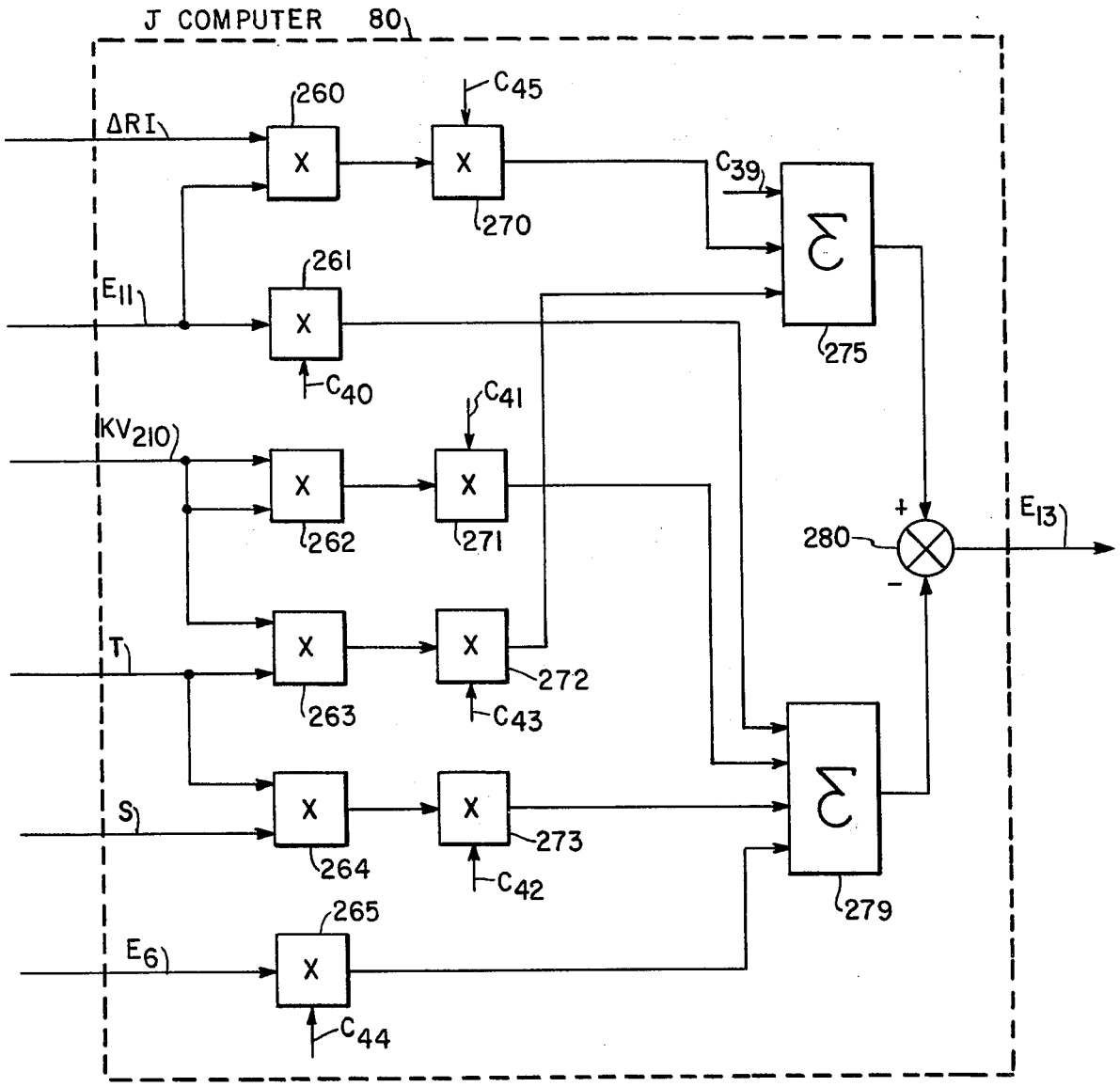

Referring now to FIG. 13, multipliers 260, 261 in J computer 80 multiply signal $E_{11}$ with signal $\Delta RI$ and a direct current voltage $C_{40}$, respectively. Multiplier 262 effectively squares signal $KV_{210}$ while multipliers 263 and 264 multiply signal T with signals $KV_{210}$ and S, respectively, to provide product signals. Multiplier 265 multiplies $E_6$ with a direct current voltage $C_{44}$ to provide a signal corresponding to the term $C_{44}(VI)$ in equation 12. Multipliers 270 through 273 multiply the signals from multipliers 260, 262, 263 and 264, respectively, with direct current voltages $C_{45}$, $C_{41}$, $C_{43}$ and $C_{42}$, respectively, to provide signals corresponding to the terms $C_{45}(\Delta VI)(\Delta RI)$, $C_{41}(KV_{210})^2$, $C_{43}(KV_{210})(T)$ and $C_{42}(S)(T)$ in equation 12. Summing means 275 effectively sums the positive terms of equation 12 when it sums a direct current voltage $C_{39}$ with the product signals from multipliers 270 and 272 to provide a sum signal. Summing means 279 effectively sums the negative terms of equation 12 when it sums the product signals from multipliers 261, 265, 271 and 273 to provide a sum signal. Subtracting means 280 subtracts the sum signal provided by summing means 279 from the sum signal provided by summing means 275 to provide signal $E_{13}$ corresponding to the N-methyl-2-pyrrolidone dosage.

The present invention as hereinbefore described controls a refining unit receiving light sour charge oil to achieve a desired charge oil flow rate for a constant MP flow rate. It is also within the scope of the present invention, as hereinbefore described, to control the MP flow rate while the light sour charge oil flow is maintained at a constant rate. Under such an arrangement, multiplier 83 is connected to computer 80 and to flow transmitter 30 and multiplies signals J and CHG to provide a product signal to divider 81. Divider 81 divides the product signal with voltage $V_2$ to provide signal SO to a flow recorder-controller which would be associated with the controlling of the MP in line 7.

What is claimed is:

1. A control system for a refining unit receiving light sour charge oil and N-methyl-2-pyrrolidone solvent, one of which is maintained at a fixed flow rate while the flow rate of the other is controlled by the control system, treats the received light sour charge oil with the received N-methyl-2-pyrrolidone to yield extract mix and raffinate, comprising gravity analyzer means for sampling the charge oil and providing a signal API corresponding to the API gravity of the charge oil, sulfur analyzer means for sampling the charge oil and providing a signal S corresponding to the sulfur content of the charge oil, viscosity analyzer means for sampling the charge oil and providing signals $KV_{150}$ and $KV_{210}$ corresponding to the kinematic viscosities, corrected to 150° F. and 210° F., respectively, flow rate sensing means for sensing the flow rates of the charge oil and of the N-methyl-2-pyrrolidone and providing signals CHG and SOLV, corresponding to the charge oil flow rate and the N-methyl-2-pyrrolidone flow rate, respectively, temperature sensing means for sensing the temperature of the extract-mix and providing a corresponding signal T, and control means connected to all of the analyzer means, and to all the sensing means for controlling the other flow rate of the charge oil and the methyl-2-pyrrolidone flow rates in accordance with signals API, S, $KV_{210}$, $KV_{150}$, T, CHG and SOLV.

2. A system as described in claim 1, in which the control means includes VI signal means connected to the viscosity analyzer means for providing a signal VI corresponding to the viscosity index of the light sour charge oil in accordance with viscosity signals $KV_{150}$ and $KV_{210}$; $SUS_{210}$ signal means connected to the viscosity analyzer means for providing a signal $SUS_{210}$ corresponding to the light sour charge oil viscosity in Saybolt Universal Seconds corrected to 210° F.; $\Delta VI$ signal means connected to the viscosity analyzer means, to the gravity analyzer means, to the sulfur analyzer means, to the VI signal means and to the $SUS_{210}$ signal means and receiving a direct current voltage $VI_{RP}$ corresponding to the viscosity index of the refined oil at the predetermined temperature for providing a signal $\Delta VI$ in accordance with signala $KV_{210}$, API, S, VI and $SUS_{210}$ and voltage $VI_{RP}$; $\Delta RI$ signal means connected to the gravity analyzer means, to viscosity analyzer means, to the sulfur analyzer means, to the VI signal means and to the $\Delta VI$ signal means for providing a signal $\Delta RI$ corresponding to the change in the refractive index from the charge oil to the raffinate; J signal means connected to the $\Delta VI$ signal means, to the temperature sensing means, to the VI signal means, to the viscosity analyzer means, to the sulfur analyzer means and to the $\Delta RI$ signal means for providing a J signal corresponding to an N-methyl-2-pyrrolidone dosage for light sour charge oil in accordance with signals $\Delta RI$, $KV_{210}$, $\Delta VI$, S, VI and T; control signal means connected to the J signal means and to the flow rate sensing means for providing a control signal in accordance with the J signal and one of the sensed flow rate signals, and apparatus means connected to the control signal means for controlling the one flow rate of the light sour charge oil and N-methyl-2-pyrrolidone flow rates in accordance with the control signal.

3. A system as described in claim 2 in which the J signal means also receives direct current voltages $C_{39}$ through $C_{45}$ and provides the J signal in accordance with the received voltages, signals $\Delta RI$, $KV_{210}$, $\Delta VI$, S, VI and T and the following equation:

$$J = C_{39} - C_{40}(\Delta VI) - C_{41}(KV_{210})^2 - C_{42}(S)(T) + C_{43}(KV_{210})(T) - C_{44}(VI) + C_{45}(\Delta VI)(\Delta RI),$$

where $C_{39}$ through $C_{45}$ are constants.

4. A system as described in claim 3 in which the $SUS_{210}$ signal means includes SUS signal means connected to the viscosity analyzer means, and receiving direct current voltages $C_{13}$ through $C_{16}$ for providing signal $SUS_{210}$ to the $\Delta VI$ signal means in accordance with signal SUS, voltages $C_{13}$ through $C_{16}$ and the following equation:

$$SUS_{210}=[C_{13}+C_{14}(C_{15}-C_{16})]SUS$$

where $C_{13}$ through $C_{16}$ are constants.

5. A system as described in claim 4 in which the VI signal means includes K signal means receiving direct current voltages $C_2$, $C_3$, $C_4$ and $T_{150}$ for providing a signal $K_{150}$ corresponding to the kinematic viscosity of the charge oil corrected to 150° F. in accordance with voltages $C_2$, $C_3$, $C_4$ and $T_{150}$, and the following equation:

$$K_{150}=[C_2-\ln(T_{150}+C_3)]/C_4,$$

where $C_2$ through $C_4$ are constants, and $T_{150}$ corresponds to a temperature of 150° F.; $H_{150}$ signal means connected to the viscosity analyzer means and receiving a direct current voltage $C_1$ for providing a signal $H_{150}$ corresponding to a viscosity H value for 150° F. in accordance with signal $KV_{150}$ and voltage $C_1$ in the following equation:

$$H_{150}=\ln\ln(KV_{150}+C_1),$$

where $C_1$ is a constant; $H_{210}$ signal means connected to the viscosity analyzer means and receiving voltage $C_1$ for providing signal $H_{210}$ corresponding to a viscosity H value for 210° F. in accordance with signal $KV_{210}$, voltage $C_1$ and the following equation:

$$H_{210}=\ln\ln(KV_{210}+C_1),$$

$H_{100}$ signal means connected to the K signal means, to the $H_{150}$ signal means and the $H_{210}$ signal means for providing a signal $H_{100}$ corresponding to a viscosity H value for 100° F., in accordance with signals $H_{150}$, $H_{210}$ and $K_{150}$ and the following equation:

$$H_{100}=H_{210}+(H_{150}-H_{210})/K_{150},$$

$KV_{100}$ signal means connected to the $H_{100}$ signal means and receiving voltage $C_1$ for providing a signal $KV_{100}$ corresponding to a kinematic viscosity for the charge oil corrected to 100° F. in accordance with signal $H_{100}$, voltage $C_1$, and the following equation:

$$KV_{100}=\exp[\exp(H_{100})]-C_1,$$

and VI memory means connected to the $KV_{100}$ signal means and to the viscosity analyzer means having a plurality of signals stored therein, corresponding to different viscosity index and controlled by signals $KV_{100}$ and $KV_{210}$ to select a stored signal and providing the selected stored signal as signal VI.

6. A system as described in claim 5 in which the ΔVI signal means includes $VI_{DWCO}$ signal means connected to the sulfur analyzer means, to the viscosity analyzer means and to the gravity analyzer means, and to the VI signal means, and receiving direct current' voltages $C_{17}$ through $C_{24}$ for providing a signal $VI_{DWCO}$ corresponding to the viscosity index of the dewaxed charge oil for 0° F. in accordance with signals S, VI, $KV_{210}$ and API, voltages $C_{17}$ through $C_{20}$ and the following equation:

$$VI_{DWCO}=C_{17}-C_{18}(S)+C_{19}(KV_{210})^2-C_{20}(VI)^2+C_{21}(S)^2+C_{22}(API)(KV_{210})-C_{23}(KV_{210})(VI)+C_{24}(VI)(S),$$

where $C_{17}$ through $C_{24}$ are constants, $VI_{DWCP}$ signal means connected to the $VI_{DWCO}$ signal means and to the $SUS_{210}$ signal means, and receiving direct current voltages $C_{25}$ through $C_{27}$ and Pour, for providing a signal $VI_{DWCP}$ corresponding to the viscosity index of the dewaxed charge oil at the predetermined temperature, in accordance with signals $VI_{DWCO}$ and $SUS_{210}$, voltages $C_{25}$ through $C_{27}$ and Pour, and the following equation:

$$VI_{DWCP}=VI_{DWCO}+(\text{Pour})[C_{25}-C_{26}\ln SUS+C_{27}(\ln SUS_{210})^2]$$

where Pour is the pour point of the dewaxed product and $C_{25}$ through $C_{27}$ are constants; subtracting means connected to the $VI_{DWCP}$ means and to the J signal means and receiving voltage $VI_{RP}$ for subtracting signal $VI_{DWCP}$ from voltage $VI_{RP}$ to provide the ΔVI signal to the J signal means.

7. A system as described in claim 6 in which the ΔRI signal also receives direct current voltages $C_{26}$ through $C_{35}$ and provides signal ΔRI in accordance with received voltages, signals $KV_{210}$, S, ΔVI, API and VI and the following equation:

$$\Delta RI=[C_{28}+C_{29}(KV_{210})-C_{30}(S)^2+C_{31}(\Delta VI)(API)-C_{32}(API)^2+C_{33}(API)(KV_{210})+C_{34}(VI)^2-C_{35}(KV_{210})(VI)+C_{36}(VI)(S)+C_{37}(\Delta VI)(KV_{210})]C_{38},$$

where $C_{28}$ through $C_{38}$ are constants.

8. A system as described in claim 7 in which the flow rate of the light sour charge oil is controlled and the flow of the N-methyl-2-pyrrolidone is maintained at a constant rate and the control signal means receives signal SOLV from the flow rate sensing means, the J signal from the J signal means and a direct current voltage corresponding to a value of 100 and provides a signal C to the apparatus means corresponding to a new light sour charge oil flow rate in accordance with the J signal, signal SOLV and the received voltage and the following equation:

$$C=(SOLV)(100)/J,$$

so as to cause the apparatus means to change the light sour charge oil flow to the new flow rate.

9. A system as described in claim 7 in which the controlled flow rate is the N-methyl-2-pyrrolidone flow rate and the flow of the light sour charge oil is maintained constant, and the control signal means is connected to the sensing means, to the J signal means and receives a direct current voltage corresponding to the value of 100 for providing a signal SO corresponding to the value of 100 for providing a signal SO corresponding to a new N-methyl-2-pyrrolidone flow rate in accordance with signals CHG and the J signal and the received voltage, and the following equation:

$$SO=(CHG)(J)/100,$$

so as to cause the N-methyl-2-pyrrolidone flow to change to the new flow rate.

* * * * *